US006231490B1

(12) United States Patent
Speil et al.

(10) Patent No.: US 6,231,490 B1
(45) Date of Patent: May 15, 2001

(54) DEVICE FOR FASTENING A FLEXIBLE PLATE ON THE PERIPHERY OF A VARNISHING-MACHINE CYLINDER

(75) Inventors: Werner Speil, Ludwigsburg; Bernhard Mokler, Markgröningen, both of (DE)

(73) Assignee: LTG Holding GmbH (DE)

( * ) Notice: Subject to any disclaimer, the term of this patent is extended or adjusted under 35 U.S.C. 154(b) by 0 days.

(21) Appl. No.: 09/112,645

(22) Filed: Jul. 9, 1998

(30) Foreign Application Priority Data

Jul. 9, 1997 (DE) ..... 197 29 375

(51) Int. Cl.[7] ..... B05C 1/08
(52) U.S. Cl. ..... 492/25; 101/415.1; 101/378
(58) Field of Search ..... 492/25, 18; 101/415.1, 101/378

(56) References Cited

U.S. PATENT DOCUMENTS

| | | | | |
|---|---|---|---|---|
| 2,743,065 | | 4/1956 | Watkins | 242/66 |
| 3,941,055 | | 3/1976 | Semmler et el. | 101/415.1 |
| 4,842,209 | | 6/1989 | Sukkonen | 242/56 R |
| 5,074,210 | * | 12/1991 | Reichel | 101/415.1 |
| 5,613,440 | * | 3/1997 | Rau | 101/415.1 |
| 5,791,244 | * | 8/1998 | Tognino | 101/415.1 |
| 5,809,890 | * | 9/1998 | Knauer et al. | 101/415.1 |
| 5,842,419 | * | 12/1998 | Puschnerat | 101/483 |
| 6,019,043 | * | 2/2000 | Knauer et al. | 101/415.1 |

FOREIGN PATENT DOCUMENTS

| | | | |
|---|---|---|---|
| 2207138 | | 9/1973 | (DE) . |
| 2313943 | | 9/1974 | (DE) . |
| 2808168 | | 8/1979 | (DE) . |
| 2908294 | | 9/1980 | (DE) . |
| 3328972 | | 2/1985 | (DE) . |
| 3416187 | * | 11/1985 | (DE) . |
| 4035621 | * | 6/1991 | (DE) . |
| 4011303 | * | 10/1991 | (DE) . |
| 3209487 | * | 12/1992 | (DE) . |
| 19701046 | * | 7/1997 | (DE) . |
| 0754640 | | 1/1997 | (EP) . |
| 2082373 | | 10/1971 | (FR) . |
| 2183223 | | 6/1987 | (GB) . |

OTHER PUBLICATIONS

German Abstract 98108285.2.

* cited by examiner

*Primary Examiner*—S. Tom Hughes
*Assistant Examiner*—Marc W. Butler
(74) *Attorney, Agent, or Firm*—Ostrolenk, Faber, Gerb & Soffen, LLP

(57) ABSTRACT

A device in an axially extending tension channel on the circumferential surface of a cylinder for fastening a flexible plate on the cylinder periphery. The leading edge of the plate is held by a leading edge fastening device in the channel, and the trailing edge is held by a trailing edge fastening device in the channel. The leading edge fastening device is a start hook-in bar which the leading edge of the plate engages. The trailing edge fastening device is formed by an end hook-in bar which is engaged by the trailing edge of the plate. The end hook-in bar projects tangentially from a tensioning shaft which is rotatable to set the tension of the plate without means to apply a clamping load. Various devices for fastening and adjusting the leading and trailing edges of the plate are disclosed.

5 Claims, 2 Drawing Sheets

DEVICE FOR FASTENING A FLEXIBLE PLATE ON THE PERIPHERY OF A VARNISHING-MACHINE CYLINDER

BACKGROUND OF THE INVENTION

The present invention relates to a device, which is arranged in an axially extending tensioning channel in a cylinder, for fastening a flexible plate around the circumferential surface of the cylinder. The device is particularly for fastening a varnishing or printing plate or a rubber blanket on the periphery of a varnishing or blanket cylinder of a varnishing machine, wherein the plate has start and end edges which and point into the tensioning channel. The leading edge of the plate is held by a leading edge fastening device and the trailing edge is held by a trailing edge fastening device.

German Offenlegungsschrift 40 11 303 discloses a device of this type. The start and the end of a rubber blanket that is tensioned on a cylinder are clamped between a top and bottom rail. In order to tension the rubber blanket, the top and bottom rails are jointly displaced radially inward into the cylinder. The fastening device for the rubber blanket extends over a relatively long distance around the circumference of the cylinder. As a result, a corresponding section of the circumferential surface overall periphery is not available for rolling purposes.

SUMMARY OF THE INVENTION

It is an object of the present invention to provide a device of the type mentioned above which has a simple construction, and extends over only a very small distance around the circumference of the cylinder, so that the leading and trailing edges of the plate can be located very closely to each other. This enables virtually the entire circumferential surface of the varnishing cylinder to be used for varnishing purposes. The usable rolling area of the varnishing cylinder surface is thus very large, that is, optimum utilization is achieved by the invention.

According to the invention, this object is achieved by the leading edge fastening device being formed by a start hook-in bar. The leading edge of the plate engages behind that bar. It is further achieved by the trailing edge fastening device being formed by an end hook-in bar, which projects tangentially from a tensioning shaft extending within and parallel to the cylinder. The trailing edge of the plate engages behind that end hook-in bar. The leading and trailing edges are each held without being clamped, but merely by the edges engaging behind the start and end hook-in bars. All that is required for fastening the plate on the cylinder is for the leading and trailing edges to engage behind the start hook-in bar and the end hook-in bar, respectively. The start and end hook-in bars can thus be located opposite each other with just a very small distance between them. It is necessary for that distance to just be sufficiently large, on the one hand, for the plate to be tensioned on the circumferential surface of the cylinder by relative movement of the two bars toward each other, that is, it must be possible to realize an adequate tensioning travel, and, on the other hand, for the leading and/or trailing edge of the plate to have an adequately large entry gap available in order to permit engagement with respect to the respective fastening device during mounting and in order to loosen this engagement during dismounting. Since the plate is held at its start and end edges merely by engagement and not by means which apply a clamping load, there is no additional space requirement for such clamping means as required in the prior art, so that the start and end of the plate lie very closely opposite each other, that is, virtually without a gap. As a result, virtually the entire circumferential surface is available as a rolling area.

In this application, when a configuration of the plate is mentioned, then this is to be understood such that this configuration is not provided directly on the plate but on its profiled end strips. The profiled end strips are viewed virtually as a constituent part of the plate, although they constitute separate components. If, therefore, mention is made, for example, of the fact that a cutout is arranged in the region of the leading edge and/or of the trailing edge of the plate, this likewise means that the cutout can also be located in the region of the leading edge and/or trailing edge of the profiled end strip/profiled end strips.

It is advantageous if the end hook-in bar projects from the tensioning shaft in a tangential direction thereto. In relation to an imaginary radius of the cylinder, the end hook-in bar, viewed in cross section, diverges from this radius. Additionally, that region of the end hook-in bar which engages the trailing edge of the plate is located approximately in the region of the point of intersection of the imaginary radius with the peripheral line of the cylinder. For this purpose, the start hook-in bar, likewise viewed in cross section, which engages the leading edge, preferably diverges from the same radius with the opposite inclination as the end hook-in bar. The two bars are inclined toward each other so as to form only the narrowest possible gap between them, at approximately the level of the outer periphery of the cylinder.

The end hook-in bar is preferably inherently elastic, and specifically is a spring element. As a result of this elastic property, inaccuracies at the ends of the plate which may be caused, for example, by production tolerances, e.g., inaccuracies in parallelism, are compensated for. Since the end hook-in bar is arranged on the tensioning shaft, as mentioned above, that bar may be moved by rotating the tensioning shaft in the direction of the start hook-in bar. This tensions the plate on the periphery of the cylinder. The tensioning shaft has a spring element, preferably in the form of a torsion bar, by which the plate is always subjected to tensile stress, and any rolling effects, and so on, are absorbed. Additionally or alternatively to the construction of the end hook-in bar as a spring element, it is possible for the end hook-in bar to be mounted eccentrically, that is, it can be adjusted in the region of one of its ends, to compensate for any possible inaccuracies in parallelism of the plate. The eccentric bearing is located, as mentioned above, in one end region of the end hook-in bar, whereas its other end region is appropriately pivotally mounted. Since inaccuracies in parallelism and the like can also occur at the start of the plate, the start hook-in bar can also preferably be adapted to the inaccuracies in parallelism, by providing a "movable" start hook-in bar fastening. Preferably, a fastening element, for example a threaded screw, engages through one end region of the start hook-in bar providing a possibility of pivoting the start hook-in bar. In the other end region of the start hook-in bar, there is a possibility of adjustment, in particular by means of a lever mechanism, so that an appropriate oblique setting of the start hook-in bar becomes possible.

The engagement angle of the leading and/or trailing edge is less than 90°, and preferably about 60°, so that there is virtually a form fit in relation to the respective hook-in bar. Even a slight tensioning of the plate thus rules out the possibility of an end of the plate coming loose. On the other hand, the ends of the plate can be lifted from the cylinder without any force being expended when the peripheral tension is loosened, enabling the plate to be changed in an extremely simple and trouble-free manner.

In relation to the construction of the leading edge and/or trailing edge of the plate, the start hook-in bar and/or the end hook-in bar is preferably contoured in its/their respective engagement region such that the parts are caused to contact one another in a form fitting manner over a large area. This provides optimum secureness and reproducibility.

In a particularly simple configuration, the leading edge and/or the trailing edge is/are formed by bent start and end regions of the plate. The bent regions enable the start and end edges of the plate to engage the start hook-in bar and end hook-in bar, respectively so that there is no need for any additional parts for fastening the plate to the cylinder. Alternatively, however, it is also possible for the leading edge and/or the trailing edge to be formed by profiled end strips fastened to the start and/or end of the plate. The profiled end strips permit snug-fitting, accurate cooperation with the respective bar and have high dimensional stability.

In particular, the profiled end strip or the profiled end strips are held on the plate by a clamp fastening. Each profiled end strip preferably has a clamping channel, in which the plate engages for being fastened. However, it is also possible for the profiled end strip to be held on the plate by adhesive bonding. In this case, too, the profiled end strip may have a channel in which the end of the plate or the start of the plate engages, with the interposition of an adhesive.

According to a preferred embodiment, the plate may have a plastic substrate material, in particular polyester, or the plate may consist of this material. In such a case, the plate is technically similar to a rubber blanket. But it can be used, for example, as a varnishing plate for varnishing. The lateral position of the plate on the cylinder, that is, for example, the central position, is predefined by an alignment device so that it is an accurate fit and is reproducible. The alignment device is preferably formed by at least one pin on the start hook-in bar and/or the end hook-in bar, and a stop edge on the plate which cooperates with this pin. The stop edge can preferably be formed by means of a cutout in the plate, the cutout being located, in particular, in the region of the leading edge and/or trailing edge of the plate.

Finally, it is advantageous if an accurately fitted position of the plate in the rotation direction of the cylinder is achieved by hooking the leading edge on the start hook-in bar without play. This is automatically ensured when the plate is hooked over the start hook-in bar in an accurately fitting manner during mounting and is then tensioned around the cylinder periphery in this position.

Other features and advantages of the present invention will become apparent from the following description of the invention which refers to the accompanying drawings.

DETAILED DESCRIPTION OF THE INVENTION

Figure 1:
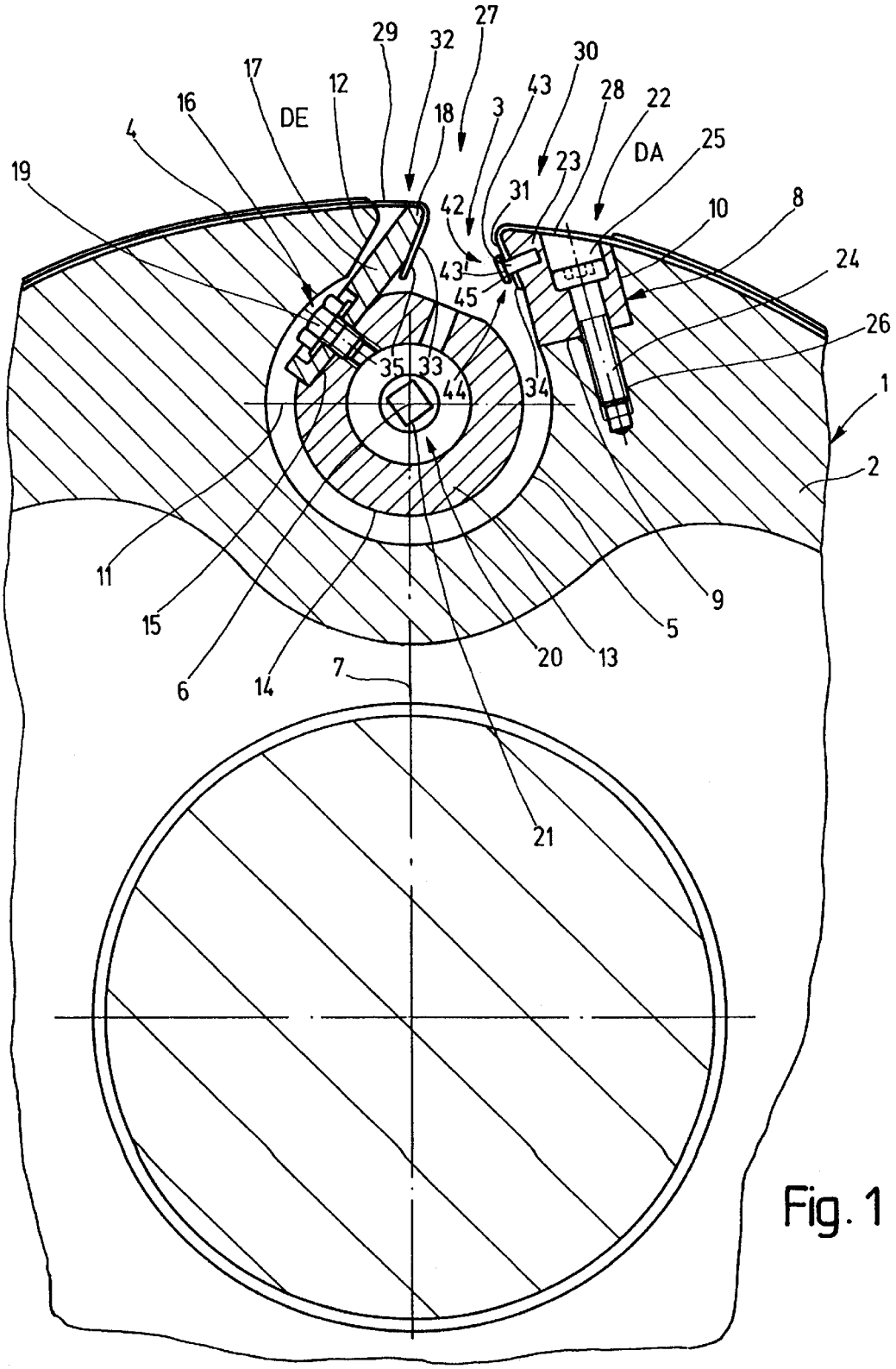
FIG. 1 shows a cross section through a varnishing cylinder for a varnishing machine (not illustrated) in the region of a fastening device.

FIG. 1 shows a cross-section of a cylinder 1, which is constructed as a varnishing cylinder 2 and is used in a varnishing machine (not illustrated). The cylinder 1 is penetrated, parallel to its axis of rotation, by a tensioning channel 3, which opens into the outer surface 4 of the varnishing cylinder 2. Viewed in cross section, the tensioning channel 3 has a wall contour 5 shaped as part of a circle, whose center 6 is located on a radius 7 of the varnishing cylinder 2. On the printing start side DA, the part-circle-shaped wall contour 5 merges into a stepped contour 8, which has a bottom face 9 and a side face 10, which are preferably at right angles. With respect to an imaginary plane 11 running at right angles to the radius 7, the bottom face 9 is tilted at an acute angle, that is to say runs at an angle in relation to the plane 11. On the printing end side DE of the tensioning channel 3, the part-circle-shaped wall contour 5 merges into an approximately flat wall contour 12, which runs at an acute angle to the radius 7 in such a way that it converges toward this radius as the distance from the center of rotation of the varnishing cylinder 2 increases. The wall contour 12 and also the side face 10 open into the outer surface 4, in each case forming a curved edge or radius.

A hollow tensioning shaft 13 is rotatably mounted within the tensioning channel 3. In the region of its outer face 14, the shaft 13 has a flat 15, on which a trailing edge fastening device 16 is arranged. This device has an end hook-in bar 17. The end hook-in bar 17 extends so that it projects away from the tensioning shaft 13. The free end 18 of the end hook-in bar 17 extends within the tensioning channel 3 approximately as far as the outer surface 4. The end hook-in bar 17 is fastened to the tensioning shaft 13 by several threaded screws 19 which are spaced apart from one another over the length of the arrangement. Each threaded screw 19 passes through a receiving hole in the end hook-in bar 17 and is screwed into a threaded hole in the hollow tensioning shaft 13.

A spring element 20 is located within the tensioning shaft 13. It is constructed as a torsion bar 21. It is possible to pretension the rotatably mounted tensioning shaft 13 in a sprung manner in the direction of rotation.

A leading edge fastening device 22 is inserted into the stepped contour 8. It has a start hook-in bar 23. In its end region, the start hook-in bar 23 is connected to the varnishing cylinder 2 by a threaded screw 24. For this purpose, the start hook-in bar 23 has a stepped hole 25, through which the threaded screw 24 passes. The threaded section of the threaded screw 24 is screwed into a corresponding threaded hole 26 in the varnishing cylinder 2. In the region of its other end, the start hook-in bar 23 has an adjusting device, in particular an adjusting device that operates in the manner of a lever, so that, as viewed in the peripheral direction of the varnishing cylinder 2, it can be set at an angle to the axis of rotation of the varnishing cylinder, in order to be able to compensate for any inaccuracies in the parallelism of a flexible plate 28 that is to be fastened on the outer surface 4 of the varnishing cylinder 2. A corresponding possibility is provided in the case of the end hook-in bar 17. This is provided by one end of the end hook-in bar 17 being mounted eccentrically, so that any possible inaccuracies in the parallelism of the plate 28 can be compensated.

The flexible plate 28 is fastened on the outer surface 4 of the varnishing cylinder 2 by means of a device 27 that is formed by the trailing-edge fastening device 16 and the leading-edge fastening device 22. The plate 28 is constructed as a varnishing plate 29, so that it can be used to carry out varnishing operations. The plate 28 has an edge 31 at its start 30 and an edge 33 at its end 32, the edge 31 forming a leading edge 34 and the edge 33 forming a trailing edge 35. Leading edge 34 and trailing edge 35 are formed by the respective end regions of the plate 28 being bent. The bending is carried out in such a way that the leading edge 34 and the trailing edge 35 each form an acute angle with the contour of the plate 28, which is conformably held to the outer surface 4. These hook-like contours form engagement angles of preferably about 60°. Mating contours corresponding to the engagement angles are formed on the start hook-in bar 23 and in the region of the free end 18 of the end hook-in bar 17. The arrangement is made in such a way that, in their respective engagement regions, the start hook-in bar 23 and the end hook-in bar 17 have such cross-sectional contours that the leading edge 34 and the trailing edge 35 of the plate 28 lie thereon in a form-fitting manner over a large area. Those regions of the plate 28 which adjoin the leading edge 34 and the trailing edge 35, and are located substantially along the cylindrical contour of the varnishing cylinder 2 or approximately follow the outer surface contour, are also supported flat on corresponding regions of the start hook-in bar 23 and end hook-in bar 17.

Correct lateral alignment of the plate 28 on the cylinder 1, that is, for example, the central position, is ensured by the alignment device 42. This has a pin 43 with a head 43', which is held by one end in the start hook-in bar 23 and its other, free end points into the tensioning channel 3. With the underside of its head 43', the pin 43, which passes out of the start hook-in bar 23, projects beyond the channel-facing surface of the start hook-in bar 23 approximately by a length which corresponds to the thickness of the plate 28. The pin 43 passes through a cutout 44, which is made in the leading edge 34 of the plate 28 and which forms a stop edge 45. This makes the reproducible, accurately fitting lateral positioning of the plate 28 possible. The cutout 44 becomes superfluous if the stop edge 45 is formed by a side edge of the plate 28, which in this case is moved toward the pin 43 until that edge makes contact for the purpose of the lateral alignment of the plate. It is of course possible for the pin 43 or the alignment device 42 also to be arranged on the end hook-in bar 17. It is also possible for a plurality of alignment devices 42 to be provided. For improved clarity, only one alignment device 42 is illustrated in FIG. 1.

The following operation occurs: In order to tension a plate 28 on the varnishing cylinder 2, the leading edge 34 of the plate is made to engage behind the start hook-in bar 23 in the region of the printing start DA. The plate is then laid around the outer surface 4 of the varnishing cylinder 2. Then the trailing edge 35 of the plate is brought into engagement behind the end hook-in bar. The tensioning shaft 13 is located in such a rotational position that the end hook-in bar 17 exerts no tension on the trailing edge 35. The plate 28 is then brought into the desired lateral position by means of the alignment device 42. Then spring tension is exerted on the tensioning shaft 13 by means of the torsion bar 21 in such a way that the free end 18 of the end hook-in bar 17 approaches the start hook-in bar 23. This engages the trailing edge 35 under spring tension and firmly tensions the plate 28 on the outer surface 4 of the varnishing cylinder 2. For dismounting the plate, the above mentioned engagement is loosened, that is, the tensioning shaft 13 is rotated in the counterclockwise direction (FIG. 1), so that the trailing edge 35 is released and the plate 28 can be removed from the varnishing cylinder 2.

The embodiment of FIG. 2 mainly corresponds to the embodiment of FIG. 1, and only essential changes are discussed below. The end hook-in bar 17 has a hook-shaped cross-sectional contour, with an end leg 36, which runs approximately in the peripheral direction of cylinder 2 and has a free end 18 at which the tensioning of the plate 28 is effected. Furthermore, the plate 28 does not have bent leading and trailing edges. Instead, profiled end strips 37 are fastened to the end regions of the plate 28. The end strips have, as viewed in cross-section, a V-shaped contour. One profiled end strip 37 has a leading edge 38 and the other profiled end strip 37 has a trailing edge 39. The leading edge 38 and the trailing edge 39 each forms one leg of the above mentioned V-shaped contour. The other leg of the respective V-shaped contour has a channel 40 or 41 respectively, in which the respective starting/trailing region of the plate 28 engages and is held by clamping or adhesive bonding.

Figure 2:
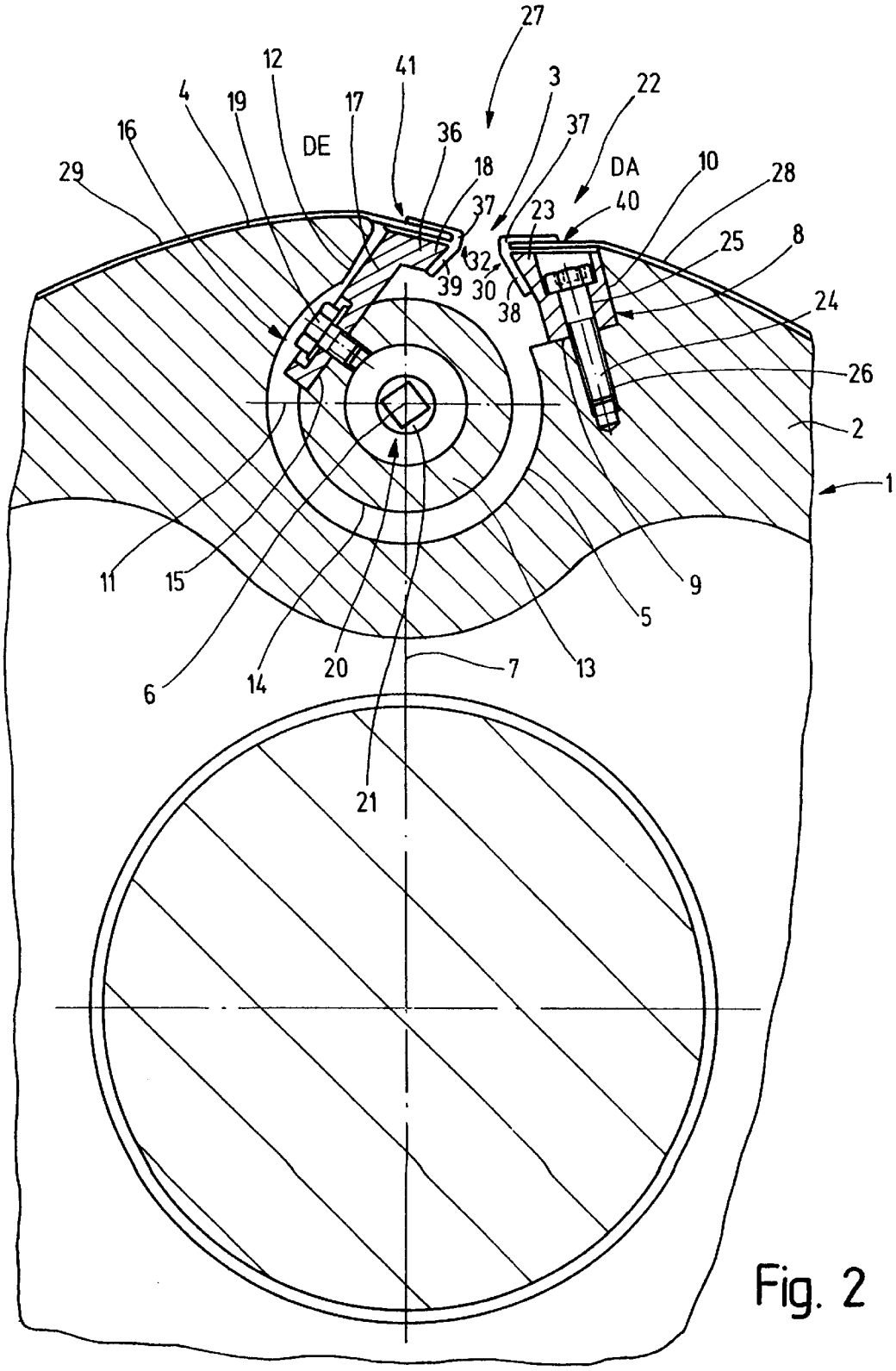
FIG. 2 shows an illustration, corresponding to FIG. 1, in accordance with a further embodiment.

The tensioned plate 28, which is preferably a varnishing plate 29, is removed from the varnishing cylinder 2 in the case of the embodiment of FIG. 2 in the same way as for the embodiment of FIG. 1.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A cylinder and plate tensioning device for fastening a flexible plate around a cylinder, the device comprising:

a cylinder having an axis and a circumferential surface, an axially extending tensioning channel extending radially in the cylinder from the circumferential surface, the channel defining a start edge and an end edge which are spaced apart at the circumferential surface of the cylinder;

the plate having a leading edge and a trailing edge and the plate being wrapped around the circumferential surface of the cylinder between the leading and trailing edges;

a leading edge fastening device clamped to the leading edge of the plate; the leading edge fastening device comprising a hanger that hangs over the start edge of the channel in the cylinder and fixes the leading edge of the plate at the start edge of the channel of the cylinder;

a tensioning shaft which is located in, extends axially along and is rotatable in the channel;

a trailing edge fastening device clamped to the trailing edge of the plate; the trailing edge fastening device extending from the tensioning shaft toward the circumferential surface of the cylinder and being rotatable with the rotation of the tensioning shaft;

a clamping element on the trailing edge fastening device for clamping the trailing edge of the plate to the trailing edge fastening device such that the leading and trailing edges of the plate are held without being clamped directly to the cylinder or clamped in the channel.

2. The cylinder and device of claim 1, further comprising a spring element on the tensioning shaft for biasing the tensioning shaft to tension the plate.

3. The cylinder and device of claim 1, wherein the plate is made of a plastic material or has a plastic substrate.

4. The cylinder and device of claim 1, wherein the leading end fastening device includes a groove in which the leading edge of the plate is clamped; and the trailing edge fastening device also includes a groove in which the trailing edge of the plate is clamped.

5. The cylinder and device of claim 4, wherein the trailing edge fastening device projects from the tensioning shaft in a direction tangential to the tensioning shaft, wherein the trailing edge of the plate is capable of being moved for adjusting the plate tension when the tensioning shaft is rotated.

* * * * *